US011467619B2

(12) United States Patent
Brunk

(10) Patent No.: US 11,467,619 B2
(45) Date of Patent: Oct. 11, 2022

(54) PUSH BUTTON DEVICE

(71) Applicant: Penn Engineering & Manufacturing Corp., Danboro, PA (US)

(72) Inventor: Jonathan Brunk, Philadelphia, PA (US)

(73) Assignee: Penn Engineering & Manufacturing Corp., Danboro, PA (US)

( * ) Notice: Subject to any disclaimer, the term of this patent is extended or adjusted under 35 U.S.C. 154(b) by 0 days.

(21) Appl. No.: 17/188,455

(22) Filed: Mar. 1, 2021

(65) Prior Publication Data

US 2021/0286398 A1 Sep. 16, 2021

Related U.S. Application Data

(60) Provisional application No. 62/987,425, filed on Mar. 10, 2020.

(51) Int. Cl.

| | |
|---|---|
| ***G05G 1/02*** | (2006.01) |
| ***G05G 5/06*** | (2006.01) |
| ***G05G 5/05*** | (2006.01) |

(52) U.S. Cl.

CPC ..... *G05G 5/06* (2013.01); *G05G 1/02* (2013.01); *G05G 5/05* (2013.01)

(58) Field of Classification Search

CPC ..... B43K 24/16; B43K 24/163; B43K 24/08; B43K 24/084; B43K 24/086; B43K 24/146; B43K 24/14; B43K 24/12; B43K 24/06; B43K 24/04; G05G 1/02; G05G 1/025

See application file for complete search history.

(56) References Cited

U.S. PATENT DOCUMENTS

| | | | | |
|---|---|---|---|---|
| 3,318,289 A * | 5/1967 | Marynissen | B43K 24/084 | 401/110 |
| 3,700,340 A * | 10/1972 | Terasaki | B43K 24/16 | 401/110 |
| 3,703,043 A * | 11/1972 | Ogata | D06F 75/18 | 38/77.83 |
| 4,976,561 A * | 12/1990 | Kageyama | B43K 27/003 | 401/74 |
| 5,641,060 A * | 6/1997 | Tracey | H01H 13/58 | 200/523 |
| 5,913,629 A * | 6/1999 | Hazzard | B43K 24/08 | 401/109 |

(Continued)

*Primary Examiner* — Richard W Ridley
*Assistant Examiner* — Brian J Mcgovern
(74) *Attorney, Agent, or Firm* — Gregory J. Gore, Esq.

(57) ABSTRACT

A push button consists of component parts including a plunger, a retainer, a spring and an end cap. The plunger reciprocates within the retainer which has three main portions: an upper portion closely holds the button on the top of the plunger and includes a rectilinear recess that can receive a square midsection of the plunger. A middle portion of the retainer comprises an enlarged cavity that provides the side clearance for the plunger pin's enlarged square midsection to rotate. The cavity is bounded above and below by opposing roof and floor camming structures which engage the corners of the plunger midsection that causes it to rotate. A spring within the retainer biases the plunger upward. An end cap affixed to the bottom of the retainer captivates the plunger and spring assembly and provides attachment means to affix the push button assembly to a supporting structure.

11 Claims, 3 Drawing Sheets

(56) References Cited

U.S. PATENT DOCUMENTS

| | | | | |
|---|---|---|---|---|
| 6,257,787 | B1 * | 7/2001 | Kirk | B43K 23/12 401/111 |
| 2003/0202836 | A1 * | 10/2003 | Tong | B43K 23/122 401/107 |
| 2003/0210945 | A1 * | 11/2003 | Noguchi | B43K 29/003 401/111 |
| 2005/0081331 | A1 * | 4/2005 | Forsythe | G05G 1/02 16/110.1 |
| 2006/0103148 | A1 * | 5/2006 | Rechberg | A47B 88/463 292/304 |
| 2009/0169285 | A1 * | 7/2009 | Cabatan | B43K 23/00 401/109 |
| 2015/0084933 | A1 * | 3/2015 | Kinoshita | G06F 3/03545 345/179 |
| 2015/0231916 | A1 * | 8/2015 | Tani | B43K 11/00 29/890.1 |
| 2018/0333980 | A1 * | 11/2018 | Namiki | B43K 24/084 |
| 2020/0218371 | A1 * | 7/2020 | Ushiku | B43K 5/005 |

* cited by examiner

PUSH BUTTON DEVICE

RELATED APPLICATIONS

This is a non-provisional patent application based upon provisional patent application Ser. No. 62/987,425 entitled, "Push Button Device" filed on Mar. 10, 2020, priority from which is hereby claimed.

FIELD OF THE INVENTION

The present invention relates to manually operated push buttons employed as mechanical actuators. More specifically it relates to push buttons which employ alternating actuation mechanisms by which a central plunger moves between stable extended and retracted positions.

BACKGROUND OF THE INVENTION

Push buttons with alternating actuation mechanisms which provide central plunger movement to between extended and retracted positions have been employed in various applications including writing instruments, door latching hardware, switch actuation, and hydraulic valve actuation, among others. In some cases, primarily in the field of pen writing instruments, the plunger alternatingly moves been stable extended and retracted positions as the plunger is pushed repeatedly in the same direction. (Hereinafter referred as "alternating actuation".)

However, a problem exists in this field because these devices have complicated or delicate mechanisms which are expensive to manufacture or are insufficiently robust for high-force industrial applications. There is therefore a need for a simplified alternate actuation push button mechanism for rugged operating environments which is inexpensive to manufacture and durable.

SUMMARY OF THE INVENTION

In order to meet the need in the art described above the applicant has devised a push button mechanism with great industrial applicability. The push button of the invention consists of a minimum number of component parts each of which are of robust construction. The components comprise a plunger, a retainer, a spring and an end cap. The plunger has three sections: the top is a button with a flat end that allows the user to depress and operate the device, a middle section has an enlarged square cross-section, and the bottom section is a pin of reduced diameter. The bottom pin is the working portion of the push button assembly that can engage related structures as a particular application may require.

The plunger reciprocates within a retainer which also has three main portions. An upper portion closely holds the button on the top of the plunger and includes a rectilinear recess that can receive the square midsection of the plunger. A middle portion of the retainer comprises an enlarged cavity that provides the side clearance for the plunger pin's enlarged square midsection to rotate. The cavity is cylindrical and bounded above and below by opposing roof and floor surfaces, respectively. The roof and the floor have camming structures which engage the corners of the plunger midsection which causes it to rotate. A bottom portion of the retainer closely holds the actuated pin of the plunger. A spring within the retainer biases the plunger upward. An end cap affixed to the bottom of the retainer captivates the plunger and spring assembly. A shank of the end cap which extends from the bottom end of the retainer provides attachment means to affix the push button assembly to a supporting structure.

More specifically, the applicant has devised a push button device comprising a retainer with opposing top and bottom ends having: an axial bore with a square recess section in an upper portion with a collar of reduced diameter at the top most end; and a central cavity of enlarged diameter with two opposite facing sets of cams on a floor and roof thereof respectively, defining the top and bottom of the cavity. A coaxial plunger is slideably operative within the retainer bore moveable between extended and retracted stable positions. The plunger comprises a cylindrical button which extends upwardly from the top end of the retainer through the collar when in the retracted position. A cylindrical pin at the distal bottom end of the plunger extends from the bottom end of the retainer when the plunger is in the extended position. An enlarged midsection of the plunger is of lateral square cross-section and sized so that the cams act upon corners of the plunger midsection to turn the plunger in the same rotational direction for each up and down reciprocal stroke of the plunger.

The midsection of the plunger is closely received in the square recess section of the retainer when in the retracted position to allow retraction of the plunger. The retainer has an end cap at the bottom end which is affixed to a body of the retainer to captivate the plunger within the retainer. A spring is operative between the end cap and the plunger midsection which urges the plunger toward the retracted position. The plunger midsection abuts the retainer collar to stop its upward advancement of the plunger defining its retracted position. The end cap is affixed to the body of the retainer and has a shank extending from the bottom of the retainer which has attachment means for affixing the retainer to a hole in a supporting structure.

Each cam in the retainer cavity has a sharply angled face which is engageable with the corners of the plunger midsection. Each set of cams consists of a circular array of cams positioned along the peripheral wall of the retainer central cavity. The opposing sets of cams are angularly offset from one another one-half the arc length of each cam. Each set of cams consist of sharply pointed vertically extending teeth.

From the following drawings and description of one embodiment of the invention it will be apparent to those of skill in the art that the objectives of the push button invention to meet the need in the art have been achieved.

DESCRIPTION OF THE PREFERRED EMBODIMENT

Figure 1:
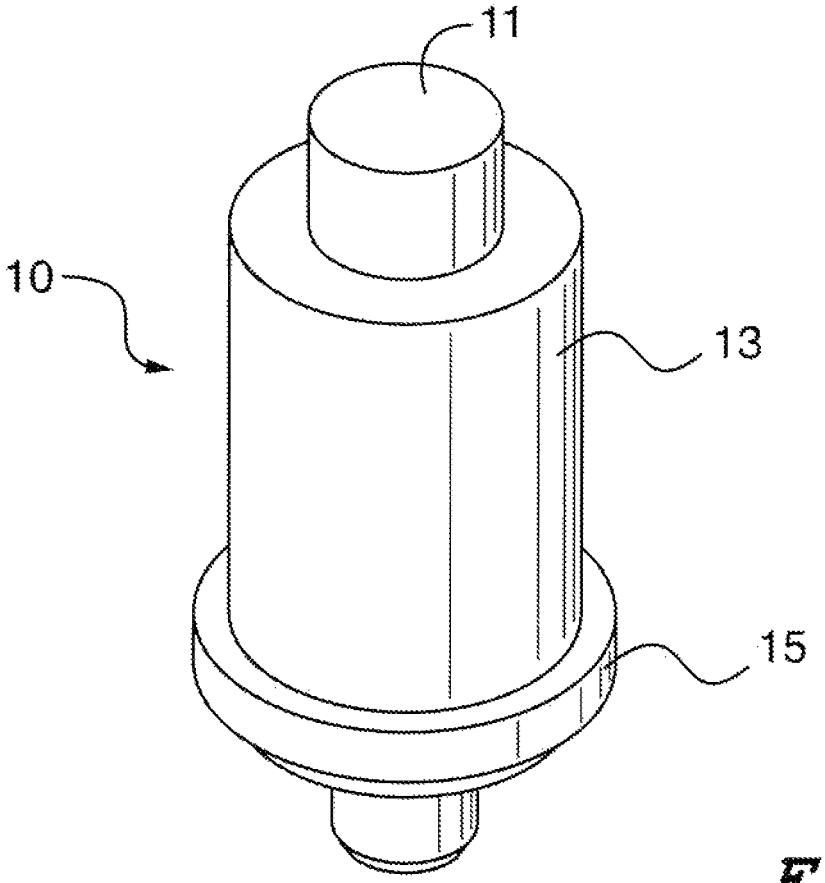
FIG. 1 is a top front perspective view.
Figure 8:
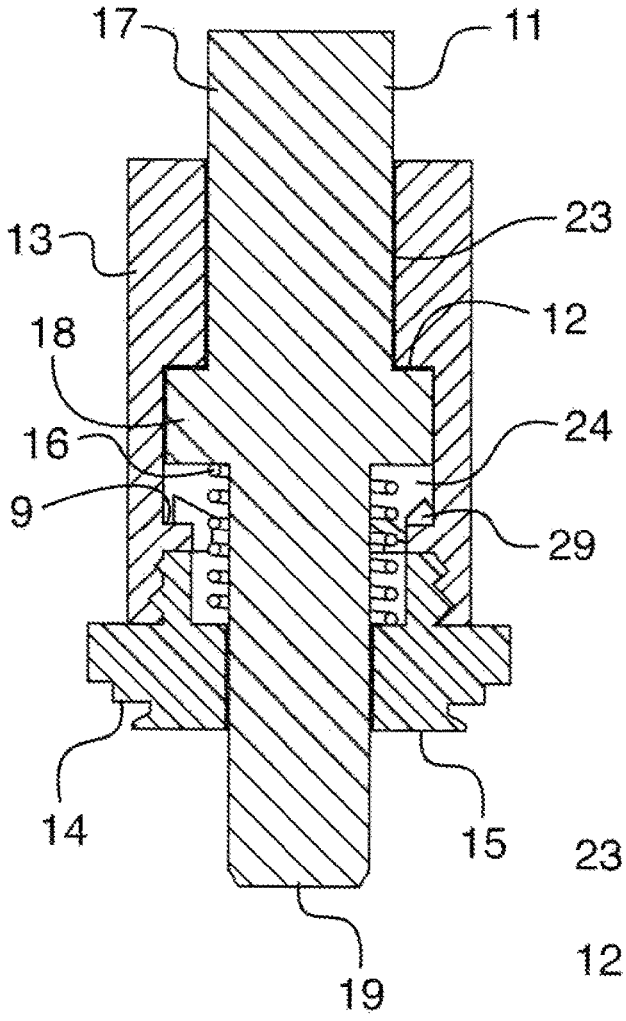
FIG. 8 is a front elevation sectional view showing the extended position.
Figure 9:
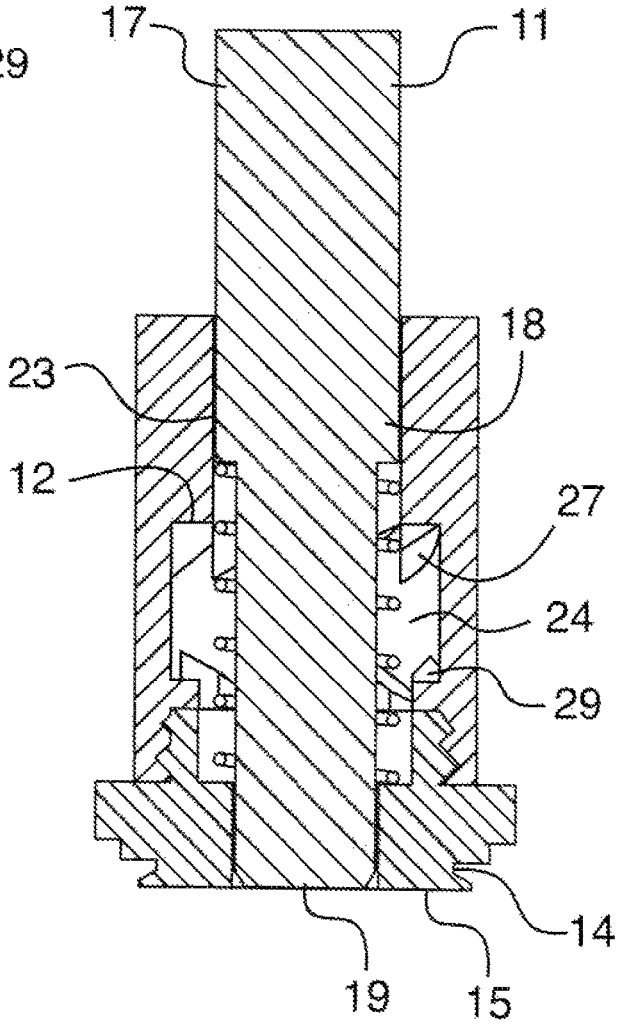
FIG. 9 is a front elevation sectional view showing the retracted position.

The following description relating to the figures of drawing use like numerals for the same elements shown in different figures for ease of cross reference without the need for individual mention to each element enumerated in a specific figure Referring now to FIG. 1 the push button 10 of the invention is shown which includes the main components: a generally cylindrical retainer body 13, a coaxial plunger 11, and an end cap 15. Additional internal features including a spring assembly are seen in FIGS. 8 and 9. One advantage of the invention is its simplicity of design requiring only a few components.

Figure 2:
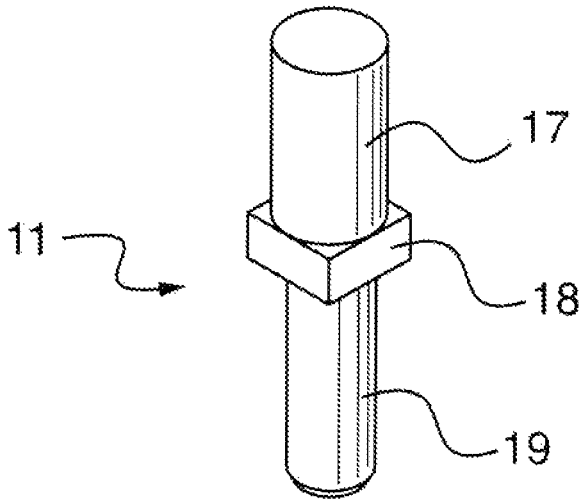
FIG. 2 is a top left perspective view.

Referring to FIG. 2, the push button plunger 11 is seen in isolation. The plunger can be understood as comprising three parts: a cylindrical top button 17, an enlarged square midsection 18, and a pin section 19 at the bottom that is the working end of the plunger.

FIGS. 3 through 7 show the details of the retainer 13 in isolation seen in top, bottom and elevation sectional views.

Figure 3:
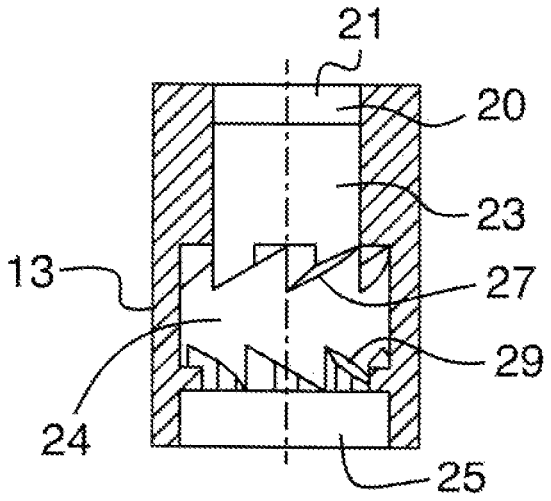
FIG. 3 is a front sectional elevation view.
Figure 4:
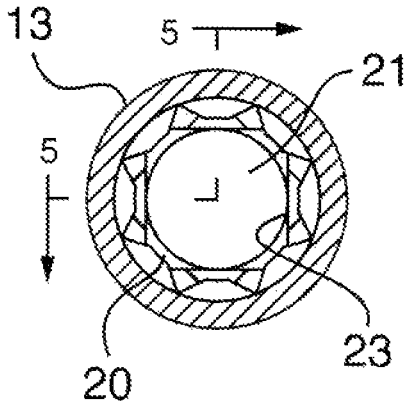
FIG. 4 is a bottom plan view.
Figure 5:
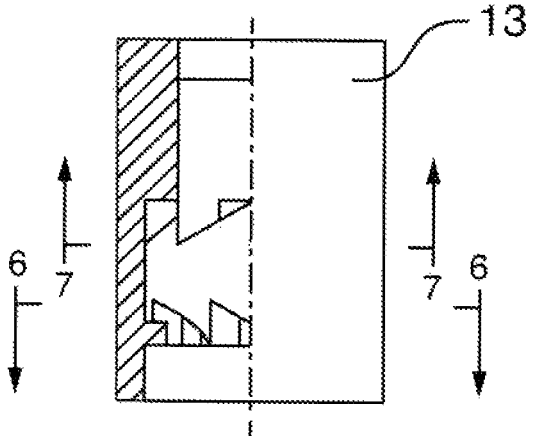
FIG. 5 is a front elevation partial sectional view taken from FIG. 4 as indicated.

Referring now to FIGS. 3, 4, and 5, the top and bottom sets of internal cams and other details of the retainer can be more clearly seen. Referring to FIG. 3, the main features of the retainer are the retaining collar 20 at the top which terminates the square cross-section recess 23 in a upper portion of the retainer. The recess transitions upwardly from a square recess 23 to a circular opening 21 of collar 20 of reduced diameter at the top most end of the retainer 13. From its top end the recess 23 progresses downwardly into an enlarged cylindrical central cavity 24 in a middle portion of the retainer. Two opposite facing sets of cams 27 and 29 are arranged along peripheral circular paths on the roof and floor of the cavity 24 respectively. A counter-bore 25 at the bottom of the retainer receives the end cap 15 as seen in FIGS. 8 and 9. The cams are each configured as pointed teeth and the cam sets are angularly offset from each other one half the arc length of each cam equating to 22.5 angular degrees. In that way the cams act upon the plunger midsection to turn or twist it. Each twist of the plunger aligns the plunger with the contacted cams and then being angularly offset from the opposing set of cams. The next stroke of the plunger will then add an additional 22.5 degrees of twist when the opposing cams are contacted by the corners of the plunger midsection. This occurs for each alternating reciprocal stroke of the plunger. The combined up and down strokes of each press/release cycle causes 45 degrees of angular rotation of the plunger.

Figure 6:
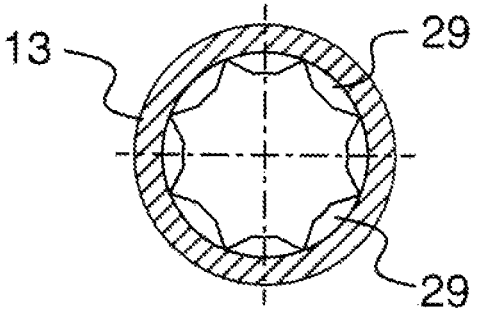
FIG. 6 is a top plan sectional view taken from FIG. 5 as indicated.
Figure 7:
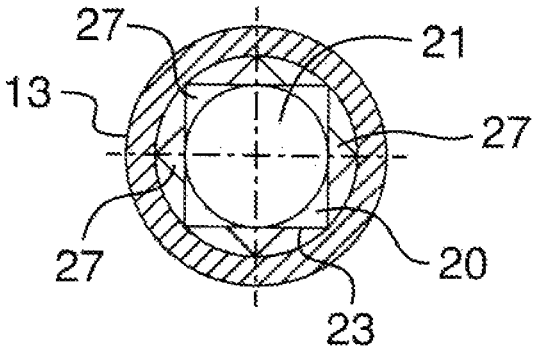
FIG. 7 is a bottom plan sectional view taken from FIG. 5 as indicated.

FIGS. 6 and 7 show the layout of the central cavity floor and roof sets of cams viewed from above and below as indicated by the sections as marked on FIG. 5, FIG. 5 being a sectioned view taken from FIG. 4. The upper roof cam set 27 contains four cams and the lower floor set 29 contains eight cams. The floor set consists of a circular array of equally spaced cams. In operation, each cam has a sharply angled face that engages one of the corners of the plunger midsection. In FIG. 7 the recess opening 23 in the upper portion of the retainer 13 is configured to closely receive the plunger midsection and extends upwardly from the cavity roof. It is depicted here to show its relation to the cavity roof cams 27. The location of each cam lies within the boundaries of the major and minor diameters of the plunger midsection so that only the edges of the plunger midsection corners contact the cams. The individual cams in each set are substantially identical and angled sharply to form a pointed peak. The sets of cams are oriented to apply a turning force to the plunger in the same rotational direction in both vertical directions of each reciprocal stroke of the plunger so that their rotary positional advancements are additive.

FIGS. 8 and 9 depict the extended and retracted stable states of the push button of the invention. Referring now to FIG. 8, an elevation cross-section view shows the internal features of the completed push button assembly. The assembly is unified by the end cap 15 which has three main features: a recess receives the bottom of the spring 16; attachment features that permit the broaching of the end cap into the bottom of the retainer; and the distal end of the end cap has a shank with attachment means 14 seen here as clinch features which permit the push button assembly to attach to a hole in a receiving panel (not shown).

As seen previously in FIGS. 3 through 7 the retainer central cavity 24 has camming structures on the cavity floor 9 and on the cavity roof 12 which impart a twisting force or torque to the plunger 11 as it is forced against the cam sets 27 and 29 when the button is fully depressed and fully released. As seen in FIGS. 6 and 7 the cams are located in opposite facing vertical directions around the periphery of the retainer cylindrical central cavity 24. The cams are positioned far enough from the axis of the plunger so that they only engage the corners of the plunger midsection 18.

In FIG. 8, we see the plunger shown in its extended position. The plunger 11 achieves this position by first manually or mechanically pushed downward until the corners of its square midsection 18 are pressed against the cams 29 on the central cavity floor. When the button is released the plunger is then moved upward by the force of the spring 16 until it contacts the cams on the cavity roof which rotates the pin 11 an additional amount. The plunger midsection 18 is now out of alignment with retainer upper square cross section recess and it stops in abutment with the central cavity roof 12. The plunger 11 is thus held in this extended position with the end pin 19 of the plunger 11 extending from the bottom of the retainer end cap 15. Positional stability of the plunger is maintained by the force of the spring 16 acting against the bottom of the plunger midsection 18.

Referring now to FIG. 9, in this figure the plunger is seen in its retracted position. This position is achieved from the extended position shown in FIG. 8 by another similar push and release of the plunger button 17 which again rotates the plunger 45 angular degrees. Here, after another application of 45 degrees of rotation to the plunger, the plunger midsection 18 is now in alignment with the retainer square recess 23. When the button is released the plunger midsection is received upwardly into the recessed bore by the force of spring 16. This retracts the pin end 19 of the plunger 11 into the end cap 15. The plunger motion is upwardly stopped by the collar seen in FIG. 3 as element 20. The collar 20 has a narrowed circular opening that receives the plunger button as it extends farther from the top of the retainer when the plunger 11 is fully retracted. The plunger 11 is held in this stable retracted position by the force of the spring 16 which operates between the endcap 15 and the bottom of the plunger midsection 18.

By these mechanical relations the present push button operates as follows. As the plunger is successively pushed and released, the action of the cams in both opposite axial directions each apply a rotational force or twist to the plunger in the same rotational direction. Each twist applied to the plunger define 22.5 degrees of rotation so that as the plunger is returned upwardly after the push/release cycle the plunger has rotated a total of 45 degrees. Now, the enlarged square midsection of the plunger is out of alignment with the top recess of the retainer so that the corners of the plunger midsection abut the roof of the central cavity preventing the farther upward retraction of the plunger. This establishes the stable extended position of the push button assembly. When the plunger is depressed and released again, the floor and roof cams acting alternately together apply at total of 45 degrees of rotation to the plunger so that it now aligns with the recess in the top of the retainer. As pressure on the button is released, the force of the internal spring moves the plunger up into the upper recess of the retainer to a stable retracted state.

The dimensions shown in the embodiment depicted may be varied to suit a particular application as desired. For example, the square portion side lengths and the diameters of the plunger pin can be made in any dimensions required. Also, the distance between the upper and lower boundaries of the central cavity can be easily modified. This distance and length of the plunger pin determines how far the pin will protrude through the bottom of the retainer end cap. The bottom region of the body, which has a counter-bore, provides sufficient material for the end cap to broach into the retainer body and captivate the assembly to the retainer as seen in FIGS. 8 and 9. The distal end of the end cap can have any suitable attachment means for affixation to a supporting structure such as a receiving panel.

While but one embodiment of the invention has been described above, it should be understood that there may be many variations to what has been shown and described that fall within the scope and spirit of the invention. It is understood that the invention is not limited to the disclosed embodiment but shall be defined only by the following claims and their legal equivalents.

What is claimed is:

1. A push button device, comprising:

a retainer with opposing top and bottom ends and an axial bore including a square recess section of the axial bore in the top end of the retainer, and a collar at a distal portion of the top end, said axial bore having a central cavity with a floor and a roof defining a bottom and a top of the central cavity respectively, said central cavity containing two opposite facing sets of cams, a cam set on the floor and a cam set on the roof;

a plunger slideably operative within the axial bore moveable between extended and retracted positions, said plunger comprising a button which extends upwardly from the top end of the retainer through the collar when in the retracted position and further having a cylindrical pin at the distal bottom end of the plunger extending from the bottom end of the retainer when the plunger is in the extended position; and a flanged midsection of the plunger of lateral square cross-section configured and constructed such that corners of the flanged midsection act upon the cams to rotate the plunger in the same rotational direction for each alternating up and down reciprocal stroke of the plunger.

2. The device of claim 1 wherein the flanged midsection of the plunger occupies the square recess section of the retainer when the plunger is in the retracted position.

3. The device of claim 2 wherein the retainer has an end cap at the bottom end which is affixed to a body of the retainer captivating the plunger within the retainer.

4. The device of claim 3 having a spring operative between the end cap and the flanged midsection which urges the plunger upwardly toward the retracted position.

5. The device of claim 3 wherein the end cap is affixed to the body of the retainer and has a shank extending from the bottom of the retainer, said shank configured to attach to a hole in a supporting structure.

6. The device of claim 1 wherein each cam has an angled face which is engageable with the corners of the flanged midsection.

7. The device of claim 6 wherein the central cavity is cylindrical.

8. The device of claim 7 wherein each set of cams comprises cams located along a peripheral wall of the central cavity.

9. The device of claim 8 wherein the cams in each set are substantially identical and the cam sets are angularly offset from one another one-half the arc length of each cam.

10. The device of claim 6 wherein the cams consist of pointed vertically extending teeth.

11. The device of claim 1 wherein the flanged midsection abuts the retainer collar when the plunger is in the retracted position.

* * * * *